United States Patent [19]

Raasch et al.

[11] Patent Number: 4,825,632

[45] Date of Patent: May 2, 1989

[54] METHOD AND DEVICE FOR MONITORING THE PIECERS IN AN OPEN-END SPINNING ASSEMBLY

[75] Inventors: Hans Raasch, Mönchen-gladbach; Helmut Schlösser, Viersen; Joachim Rüge; Heinz-Dieter Goebbels, both of Mönchen-gladbach; Manfred Lassmann, Nettetal; Norbert Schippers, Mönchengladbach, all of Fed. Rep. of Germany

[73] Assignee: W. Schlafhorst & Co., Mönchen-gladbach, Fed. Rep. of Germany

[21] Appl. No.: 196,030

[22] Filed: May 19, 1988

[30] Foreign Application Priority Data

May 19, 1987 [DE] Fed. Rep. of Germany ..... 3716728

[51] Int. Cl.[4] ..... D01H 13/26

[52] U.S. Cl. ..... 57/264; 57/261; 57/263

[58] Field of Search ..... 57/261–264, 57/22

[56] References Cited

U.S. PATENT DOCUMENTS

| | | | |
|---|---|---|---|
| 4,007,457 | 2/1977 | Aeppli | 57/264 X |
| 4,102,116 | 7/1978 | Derichs et al. | 57/264 X |
| 4,137,699 | 2/1979 | Stahlecker et al. | 57/263 X |
| 4,150,530 | 4/1979 | Derichs | 57/263 |
| 4,195,345 | 3/1980 | Artzt et al. | 57/264 X |
| 4,489,544 | 12/1984 | Morita et al. | 57/264 X |
| 4,660,365 | 4/1987 | Raasch | 57/264 X |
| 4,691,509 | 9/1987 | Stahlecker | 57/264 |

FOREIGN PATENT DOCUMENTS

| | | |
|---|---|---|
| 2344600 | 4/1974 | Fed. Rep. of Germany . |
| 2725105 | 12/1978 | Fed. Rep. of Germany . |
| 3530905 | 4/1986 | Fed. Rep. of Germany . |
| 3606466 | 9/1986 | Fed. Rep. of Germany . |

*Primary Examiner*—Donald Watkins

*Attorney, Agent, or Firm*—Herbert L. Lerner; Laurence A. Greenberg

[57] ABSTRACT

A open-end spinning assembly includes a silver insertion device, a fiber separating device, a fiber guide device, a fiber collector for collecting, aligning and imparting a rotational movement onto fibers and subsequently applying the fibers to an open yarn end, and a draw-off device drawing-off yarn from the yarn collector. A fed-back yarn end is applied to a piecing fiber quantity fed into fiber collector for forming a piecer. The yarn is continuously drawn-off from the fiber collector and fibers and continuously fed into the fiber collector. A method for monitoring the piecers includes automatically measuring diameter values relative to the longitudinal axis of the yarn for the piecer and for yarn lengths upstream and downstream of the piecer having at least substantially the length of the piecer. The diameter values are electronically stored in memory and compared with comparison values for producing a comparison result. Intervention options are derived from the comparison result for improving future piecers and especially for improving the piecer profile. A piecer monitoring device includes a first device for automatically measuring the diameter values. A second device electronically stores the measured diameter values relative to length in memory. A third device compares the measured diameter values relative to length with comparison values. A fourth device derives intervention options for improving the piecer profile of future piecers.

17 Claims, 1 Drawing Sheet

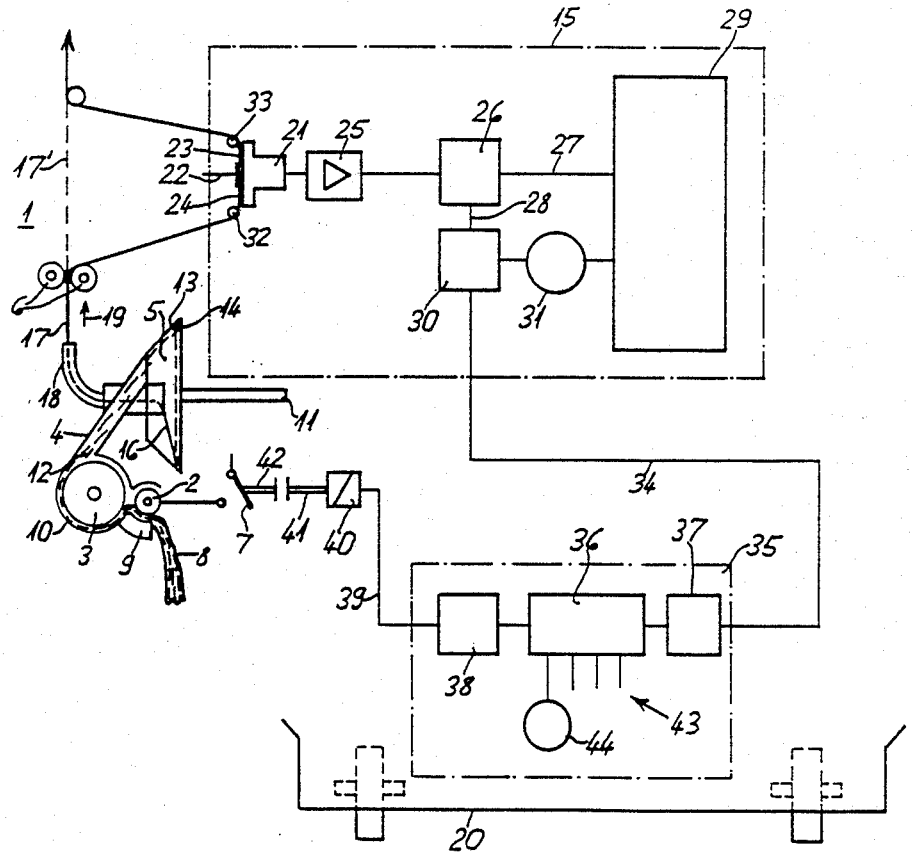
15
29
33
21
25
26
27
23
22
24
28
17'
1
32
30
31
13
14
19
5
17
18
11
4
16
12
42
2
34
10
3
9
8
7
41
40
36
37
35
39
38
43
44
20

METHOD AND DEVICE FOR MONITORING THE PIECERS IN AN OPEN-END SPINNING ASSEMBLY

The invention relates to a method and device for monitoring the piecers in an open-end spinning assembly, including a sliver insertion device, a fiber separating device, a fiber guide device, a fiber collector that collects, aligns and imparts a rotational movement to the fibers and subsequently applies the fibers to an open yarn end, and a draw-off device drawing-off the yarn from the yarn collector, wherein the fed-back yarn end is applied to a piecing fiber quantity fed into the fiber collector for forming the piecer, whereupon the yarn is continuously drawn-off from the fiber collector and fibers are continuously fed into the fiber collector.

The type of fiber collector is of secondary importance when practicing the invention. As is well known, variously constructed fiber collectors exist and the manner in which a fiber collector imparts a rotational movement to the fibers is similarly varied. For example, if the fiber collector is constructed in the form of a rotor and if the rotor has a fiber collecting groove, then the fibers enter the fiber collecting groove lengthwise and revolve about the axis of rotation of the fiber collector. In other fiber collectors, a rotational motion about the longitudinal axis of the fibers, for instance, is imparted to the fibers.

In open-end rotor spinning machines in particular, some important factors affecting the quality of the piecer are the circumferential speed with which the fiber collector rotates just at the instant at which the fed-back yarn end touches the piecing fiber quantity present in the fiber collector, the quantity of the piecing fibers at that instant, the speed at which the yarn can subsequently be moved from the feedback movement into the drawing-off movement, and the drawing-off speed with which the yarn is then removed.

During automatic piecing, a piecing program is used and it is difficult to attain good quality of the piecer from the beginning.

When piecing, if the correct variables are to be varied by the correct amount, in order to finally attain piecers of good quality, then a basic condition is that the piecers be monitored. German Published, Non-Prosecuted Applications DE-OS No. 35 30 905 and DE-OS No. 27 25 105 are cited in this regard.

It is accordingly an object of the invention to provide a method and device for monitoring the piecers in an open-end spinning assembly, which overcome the hereinafore-mentioned disadvantages of the heretofore-known methods and devices of this general type, which obtain data and which make the data available for assuring the quality of the piecers by monitoring the piecers.

With the foregoing and other objects in view there is provided, in accordance with the invention, in an open-end spinning assembly including a sliver insertion device, a fiber separating device downstream of the sliver insertion device as seen in sliver travel direction, a fiber guide device downstream of the fiber separating device, a fiber collector downstream of the fiber guide device for collecting, aligning and imparting a rotational movement onto fibers and subsequently applying the fibers to an open yarn end, and a draw-off device drawing-off yarn from the yarn collector, wherein a fed-back yarn end is applied to a piecing fiber quantity fed into the fiber collector for forming a piecer, the yarn is continuously drawn-off from the fiber collector, and fibers are continuously fed into the fiber collector; a method for monitoring the piecers which comprises automatically measuring diameter values relative to the longitudinal axis of the yarn for the piecer and for yarn lengths upstream and downstream of the piecer having at least substantially the length of the piecer, electronically storing the diameter values in memory, comprising the diameter values with comparison values for producing a comparison result, and deriving intervention options from the comparison result for improving future piecers and especially for improving the piecer profile.

Accordingly, diameter values relative to length are obtained, from which the piecer profile, for instance, including the yarn length located upstream and downstream of the piecer, is derived. The diameter can, for example, be detected per millimeter of yarn length. With shorter lengths, a more precise replica of the piecer profile or yarn profile is obtained, while with longer yarn lengths or longer intervals in diameter detection, a coarser replica of the piecer profile or yarn profile is obtained.

The diameter values relative to length are stored electronically in memory, such as digitally, and they are compared with comparison values, so that intervention options for improving future piecers can be purposefully ascertained directly from this comparison.

Some experience was necessary to discover the most favorable piecer profile for every type of yarn and every fiber material and then to use it as a standard. Further features of the invention also make a contribution to this aspect.

In accordance with another mode of the invention, the result of comparison is used for electronic control of an automatically operating piecing device. The piecing device is primarly a movable piecing device, or one which can be moved from plate to place and services individual spinning stations or open-end spinning assemblies in succession. The piecing device may function in accordance with a predetermined program, but one which is adaptable according to the invention.

In accordance with a further mode of the invention, the result of the comparison is used for dimensioning a piecing fiber quantity previously fed into the fiber collector. This step is of particular interest for open-end rotor spinning apparatus. Pre-storing a certain fiber quantity prior to the actual laying-on of the yarn is of decisive significance for the quality of the piecer. The determination of the pre-storing quantity of fibers is also particularly critical, while the instants at which the continuous yarn feeding and the yarn draw-off begin are easier to determine and are not as critical.

When dimensioning a piecing fiber quantity previously fed into the yarn fiber collector, the measurements means that considerable variations in quantity can occur when the next subsequent piecer is produced. The result can be abrupt, measurable and visible piecer changes, which are undesirable. It is accordingly an added mode of the invention that upon each change in the piecer yarn quantity, the fiber quantity neither exceeds nor drops below a predetermined correction fiber quantity, within tolerance limits. From time to time, variations of the piecer can be accomplished in preselectable small steps. This compensates for random factors resulting from the measurement process.

In accordance with an additional mode of the invention, mean values are formed from the diameter values relative to the length obtained from continuously performed piecing processes, and the comparison values are derived or formed from these mean values. The mean value formation can be subjected to certain limits. For example, the number of measurements to be used for the mean value formation may be limited. It may also be specified whether the mean value are to be obtained from continuous measurement, or whether the production of only every second, tenth or $n^{th}$ piecer should be used for the mean value formation. This step provides a more accurate approach to the ideal comparison value of the particular spinning batch.

With the objects of the invention in view, there is also provided, in an open-end spinning assembly of an open-end spinning machine including a sliver insertion device, a fiber separating device downstream of the sliver insertion device as seen in sliver travel direction, a fiber guide devide downstream of the fiber separating device, a fiber collector downstream of the fiber guide device for collecting, aligning and imparting a rotational movement onto fibers and subsequently applying the fibers to an open yarn end, and a draw-off device drawing-off yarn from the yarn collector, a fed-back yarn end being applied to a piecing fiber quantity fed into the fiber collector for forming a piecer, the yarn being continuously drawn off from the fiber collector and fibers being continuously fed into the fiber collector; a piecer monitoring device comprising first means for automatically measuring diameter values in association with the longitudinal yarn axis of the piecer and of yarn lengths upstream and downstream of the piecer having at least the length of the piecer; second means connected to said first means for electronically storing the measured diameter values relative to length in memory; third means connected to said second means for comparing the measured diameter values relative to length with comparison values; and fourth means for deriving intervention options for improving the piecer profile of future piecers.

According to the invention, all of these devices need only be present individually, if the open-end spinning machine has only one movable piecing device, that is a piecing device which is movable from place to place.

In accordance with another feature of the invention, the device for deriving intervention options for improving the piecer profile of future piecers has a controllable piecing fiber quantity metering device.

The metering of the piecing fiber quantities can be carried out completely automatically. The metering of the piecing fiber quantity can furthermore be performed independently of other intervention options for improving the piecing profile of future piecers. Based on indicated comparison values, for example, the piecing program can also be manually varied from time to time for an instant during various portions of the entire piecing process. An automatic variation of this kind is also possible.

In accordance with a further feature of the invention, the piecing fiber quantity metering device has a releasable operative connection with the sliver insertion device of the open-end spinning assembly.

In accordance with an added feature of the invention, there is provided a yarn signal pickup connected to at least one comparator responding to yarn signals deviating from comparison values.

Even if the yarn signal pickup has already begun to process a relatively long length before the piecer and if it stops its activity again at a relatively long distance after the piecer, the limited length that begins relatively shortly before the piecer and stops relatively shortly after the piecer can still be filtered out of its yarn signals.

In accordance with an additional feature of the invention, the device for automatically measuring the diameter values relative to length and/or the device for electronically storing the measured diameter values in memory relative to length and/or the comparator, are connected to a mean value former.

In accordance with yet another feature of the invention, the comparator adopts the mean value of the measured diameter values relative to length which are formed in the mean value former, as comparison values. A set-point value transducer may be provided an intermediate element between the mean value formed and the comparator. The set-point transducer may be selectively set for manual operation or automatic operation, for example.

In accordance with a concomitant feature of the invention, the piecing fiber quantity metering device is connected to a correction quantity adjuster. The correction quantity adjuster may be manually or automatically adjustable. The size of the permissible correction quantity can, for example, be made automatically dependent on how many piecers have been produced in a predetermined preceding period of time.

Other features which are considered as characteristic for the invention are set forth in the appended claims.

Although the invention is illustrated and described herein as embodied in a method and device for monitoring the piecers in an open-end spinning assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawing.

The drawing is a diagrammatic and block circuit diagram of a monitoring device according to the invention.

Referring now to the single FIGURE of the drawing in detail, there is seen an open-end spinning machine with a plurality of open-end spinning assemblies 1, each having a sliver insertion device 2, a fiber separating device 3, a fiber guide device 4, a fiber collector 5 and a draw-off device 6.

The sliver insertion device 2 is formed of an insertion roller driven by an electric motor. Switch 7 is connected upstream of the electric motor. Sliver 8 passes over a delivery table 9 beneath the insertion or feed roller of the sliver insertion device 2 and through to the separating device 3. The separating device 3 is formed of a rotating toothed roller. The fiber guide device 4 is in the form of a fiber conduit, which extends from the housing 10 of the separating device 3 as far as the fiber collector 5. The fiber collector 5 is in the form of a rotor which is mounted on a shaft 11. Fibers 12 which are separated by the separating device 3 initially reach a sliding surface 13 in the form of a conical jacket and from there they travel into a fiber collecting groove 14 of the rotating fiber collector 5.

The fiber collector 5 imparts a rotational motion to the fibers located in the fiber collecting groove 14. The fact that the fibers are oriented lengthwise in the fiber collecting groove 14 causes them to rotate about the common axis of rotation of the shaft 11 and fiber collector 5.

The fibers located in in the fiber collecting groove 14 are placed onto a yarn or thread end 16. Yarn 17 belonging to the yarn end 16 is drawn off continuously through a yarn draw-off tube 18 in the direction of an arrow 19, with the aid of the draw-off device 6. The draw-off device 6 is formed of a pair of rollers.

During normal spinning operation, the yarn 17 travels as indicated by a broken line 17'. The yarn is continuously wound onto non-illustrated cheese or cross-wound bobbin. The draw-off device 6 can be shifted from forward operation to reverse operation for piecing and feeding back the yarn to the fiber collector 5.

The open-end spinning machine has a movable piecing, thread joining, or spinning starting device 20 associated with therewith. The piecing device 20 migrates from one spinning assembly to another and is in a position to automatically perform either re-piecing or thread joining after a yarn break or initial piecing or spinning starting. To this end, the piecing device 20 comes to a stop in front of the applicable spinning assembly and then performs the individual tasks required for piecing in accordance with a program, which may be controlled by adjustable or controllable timing relays.

The drawing only diagrammatically shows the parts of the piecing device 20 that are important for a comprehension of the invention.

The following parts are combined in a unit 15:

A device or first means 21 is provided for automatically measuring diameter values relative to the longitudinal yarn axis of a piecer 22 and of yarn lengths 23 and 24 which are located upstream and downstream of the piecer 22 and each of which has at least the length of the piecer 22. An amplifier 25 is connected to the device 21 and to a device or second means 26 for electronically storing the measured diameter values relative to length in memory. A line 27 leads from the device 26 to a mean value former 29 and a line 28 leads to a comparator or third means 30. The comparator 30 compares the measured diameter values relative to length with comparison values specified to it by a set-point transducer 31. The set-point value transducer 31 is connected to the mean value former 29, so that it can adopt the mean values formed therein as set-point values.

The device 21 is a yarn signal pickup, which in this case is disposed in such a way that it can observe and measure both the piecer 22 and the yarn lengths 23 and 24 located upstream and downstream of the piecer, all at the same instant. The memory device 26 stores in memory those measured values that result at the instant when the piecer 22 is located midway between two yarn guides 32 and 33 and thus also midway in front of the yarn signal pickup 21. The memory device 26 passes its contents to the mean value former 29 in order to form a mean value from previously performed measurements and it passes it to the comparator 30 for forming a comparison value.

The comparison value ascertained by the comparator 30 passes through a line 34 to a device or fourth means 35 for deriving intervention options for improving the piecer profile of future piecers.

The device 35 includes a computer in the form of a piecing fiber quantity metering device 36, which is connected downstream of a memory 37 connected to the comparator 30 by the line 34. A signal converter 38 adjoins the computer 36. The signal converter 38 can selectively emit analog or digital control signals, as correction signals for the sliver insertion device 2. A line 39 leads from the signal converter 38 to an electromagnet drive 40, which can establish a releasable operative connection with the switch 7 of the sliver insertion device 2. The operative connection is established due to the fact that the electromagnetic drive 40 moves a tappet 41 outward, in order to mechanically act on a shift lever 42 of the switch 7 for switching the switch 7 on or back off again after retraction of the tappet 41. In any case, the switch 7 can also be switched on and off electromagnetically by the open-end spinning assembly 1 in a non-illustrated manner. However, as long as the piecing device 20 is active in front of the open-end spinning assembly 1, it performs the function of switching the switch 7.

When the piecer 22 is produced, which is done in a manner known per se and is therefore not described in detail herein, the yarn guides 32 and 33 pull the yarn 17 from the normal travel location 17' to a location in front of the device 21, which begins its measurements early enough so that as the yarn travels it can detect both the piecer 22 and the yarn lengths 23 and 24 located upstream and downstream of the piecer, at the correct instant. The amplified yarn signals stored in memory in the device 26 are compared with comparison values in the comparator 30, and the result of comparison is sent through the line 34 to the device 35, where it is stored in the memory 37 for producing a future piecer. The previous comparison result is also stored in the memory 37, so that the computer 36 can compare the two results of comparison with one another in order to ascertain whether or not the piecer 22 which is present at that time meets the quality standard.

If the piecer 22 does not meet the quality standard, then the computer 36 causes the switch 7 to open through the signal converter 38 and the electromagnet drive 40, thus preventing further delivery of the sliver 8 and causing a yarn break. As a consequence, the piecing process must be repeated again. The drawing shows that the piecer 22 has not met the quality standard and that the switch 7 has already been switched off.

Only the most recently measured comparison value then remains in the memory 37 for the next successive piecing process.

Once the piecer 22 is located in front of the device 21, the sliver insertion device 22 operates at operational speed whenever the piecer is of good quality. The two yarn guides 32 and 33 then move toward the left, in order to place the yarn 17 into its normal travel location 17'. The two yarn guides 32 and 33 then release the yarn 17. Once the switch 7 is again connected to an actuating device that is individually associated with one spinning assembly, the piecing device 20 can move to a new working location. At the new location, the piecing device 20 then again takes on the task of switching the switch 7 at that location in accordance with the result of a comparison of the preceding piecer measurement which is stored in the memory 37 and performed at the open-end spinning assembly 1. Before the piecer is produced, the switch 7 is temporarily switched on, in accordance with the ON time ascertained by the piecer fiber quantity metering device 36, in order to feed a predetermined piecing fiber quantity into the fiber collector 5. The maximum possible ON time is set at a correction quantity adjuster 44. Subsequently, the draw-off device 6 is started and the yarn 17 is drawn off continuously in the direction of the arrow 19. The switch 7 is switched back on again at the start-up of the draw-off device 6. If the piecer 22 should not meet the quality required, then the switch 7 is switched off again, but otherwise it remains on.

The computer 36 also has several outputs 43, to which indicator devices, recording devices, reporting devices or quite generally other devices for deriving intervention options for improving the piecer profile of future piecers, can be connected. The piecer profile can not only be influenced by the quantity of fibers previously fed in, but also by controlling the draw-off device 6, the sliver insertion device 2, and/or the separating device 3, and/or the rpm of the shaft 11.

The device 21 may be constructed in various ways. For example, it can be so constructed in such a way that it optoelectrically detects the diameter or profile of the yarn or piecer over a predetermined short yarn length and processes the yarn signal into a course of a curve, for example. The yarn signal can also be detected capacitively or in any other known manner. Regardless of how the yarn signals are ascertained, a more or less precise electronic replica of the piecer and of its adjoining yarn lengths is finally present in the device 26.

The foregoing is a description corresponding in substance to German Application No. P 37 16 728.6, dated May 19, 1987, the International priority of which is being claimed for the instant application, and which is hereby made part of this application. Any material discrepancies between the foregoing specification and the aforementioned corresponding German application are to be resolved in favor of the latter.

We claim:

1. In an open-end spinning assembly including a sliver insertion device, a fiber separating device downstream of the sliver insertion device as seen in sliver travel direction, a fiber guide device downstream of the fiber separating device, a fiber collector downstream of the fiber guide device for collecting, aligning and imparting a rotational movement onto fibers and subsequently applying the fibers to an open yarn end, and a draw-off device drawing-off yarn from the yarn collector, wherein a fed-back yarn end is applied to a piecing fiber quantity fed into the fiber collector for forming a piecer, the yarn is continuously drawn-off from the fiber collector, and fibers are continuously fed into the fiber collector;

a method for monitoring the piecers with comprises automatically measuring diameter values relative to the longitudinal axis of the yarn for the piecer and for yarn lengths upstream and downstream of the piecer having at least substantially the length of the piecer, electronically storing the diameter values in memory, comparing the diameter values with comparison values for producing a comparison result, and deriving intervention options from the comparison result for improving future piecers.

2. Method according to claim 1, which comprises deriving intervention options for improving the piecer profile from the comparison result.

3. Method according to claim 1, which comprises electronically controlling an automatically operating piecing device according to the comparison result.

4. Method according to claim 3, which comprises dimensioning a piecing fiber quantity previously fed into the fiber collector according to the comparison result.

5. Method according to claim 4, which comprises maintaining a fiber quantity at a predetermined correction fiber quantity within tolerance limits, upon each change in yarn quantity of the piecer.

6. Method according to claim 1, which comprises forming mean values from the diameter values relative to lengths obtained from continuously performed piecing processes, and deriving and forming the comparison values from the mean values.

7. Method for monitoring piecers in an open-end spinning assembly, which comprises continuously feeding fibers into a fiber collector, applying a fed-back yarn end to a piecing fiber quantity fed into the fiber collector for forming a piecer, continuously drawing-off yarn from the fiber collector, automatically measuring diameter values relative to the longitudinal axis of the yarn for the piecer and for yarn lengths upstream and downstream of the piecer having at least substantially the length of the piecer, electronically storing the diameter values in memory, comparing the diameter values with comparison values for producing a comparison result, and driving intervention options from the comparison result for improving future piecers.

8. In an open-end spinning assembly of an open-end spinning machine including a sliver insertion device, a fiber separating device downstream of the sliver insertion device as seen in sliver travel direction, a fiber guide device downstream of the fiber separating device, a fiber collector downstream of the fiber guide device for collecting, aligning and imparting a rotational movement onto fibers and subsequently applying the fibers to an open yarn end, and a draw-off device drawing-off yarn from the yarn collector, a fed-back yarn end being applied to a piecing fiber quantity fed into the fiber collector for forming a piecer, the yarn being continuously drawn off from the fiber collector and fibers being continuously fed into the fiber collector;

a piecer monitoring device comprising first means for automatically measuring diameter values in association with the longitudinal yarn axis of the piecer and of yarn lengths upstream and downstream of the piecer having at least the length of the piecer;

second means connected to said first means for electronically storing the measured diameter values relative to length in memory;

third means connected to said second means for comparing the measured diameter values relative to length with comparison values; and fourth means for deriving intervention options for improving the piecer profile of future piecers.

9. Piecer monitoring device according to claim 8, wherein said fourth means for deriving intervention options for improving the piecer profile of future piecers includes a controllable piecing fiber quantity metering device.

10. Piecer monitoring device according to claim 9, including a releasable operative connection from said piecing fiber quantity metering device to the sliver insertion device.

11. Piecer monitoring device according to claim 9, wherein said first means are in the form of a yarn signal pickup, and said third means are in the form of at least one comparator responding to yarn signals deviating from comparison values.

12. Piecer monitoring device according to claim 8, including a mean value former connected to said second means.

13. Piecer monitoring device according to claim 8, including a mean value former connected to said third means.

14. Piecer monitoring device according to claim 8, including a mean value former connected to said second means and said third means.

15. Piecing device according to claim 11, including a mean value former connected to said comparator, said comparator adopting a mean value of the measured diameter values formed in said mean value former relative to length as comparison values.

16. Piecing device according to claim 9, including a correction quantity adjuster connected to said piecing fiber quantity metering device.

17. In an open-end spinning assembly of an open-end spinning machine wherein a fed-back yarn end is applied to a piecing fiber quantity fed into a fiber collector for forming a piecer, yarn is continuously drawn off from the fiber collector and fibers are continuously fed into the fiber collector;

a piecer monitoring device comprising first means for automatically measuring diameter values in association with the longitudinal yarn axis of the piecer and of yarn lengths upstream and downstream of the piecer having at least the length of the piecer;

second means connected to said first means for electronically storing the measured diameter values relative to length in memory;

third means connected to said second means for comparing the measured diameter values relative to length with comparison values; and fourth means for deriving intervention options for improving the piecer profile of future piecers.

* * * * *